US006801167B2

(12) United States Patent
Shibata

(10) Patent No.: US 6,801,167 B2
(45) Date of Patent: Oct. 5, 2004

(54) DIELECTRIC ANTENNA

(75) Inventor: Masaki Shibata, Mie (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/396,691

(22) Filed: Mar. 26, 2003

(65) Prior Publication Data

US 2003/0184480 A1 Oct. 2, 2003

(30) Foreign Application Priority Data

Mar. 26, 2002 (JP) ..... 2002-084738
Mar. 26, 2002 (JP) ..... 2002-084752

(51) Int. Cl.[7] ..... H01Q 1/38
(52) U.S. Cl. ..... 343/700 MS
(58) Field of Search ..... 343/700 MS, 829, 343/830, 846

(56) References Cited

U.S. PATENT DOCUMENTS

| | | | | |
|---|---|---|---|---|
| 4,197,544 A | | 4/1980 | Kaloi | |
| 4,415,900 A | | 11/1983 | Kaloi | |
| 4,853,703 A | * | 8/1989 | Murakami et al. | 343/700 MS |
| 5,678,216 A | | 10/1997 | Matai | |
| 5,680,144 A | * | 10/1997 | Sanad | 343/700 MS |
| 5,703,601 A | * | 12/1997 | Nalbandian et al. | 343/700 MS |
| 5,861,019 A | | 1/1999 | Sun et al. | |
| 5,898,403 A | * | 4/1999 | Saitoh et al. | 343/700 MS |
| 5,973,651 A | | 10/1999 | Suesada et al. | |
| 6,181,279 B1 | * | 1/2001 | Van Hoozen | 343/700 MS |

FOREIGN PATENT DOCUMENTS

| | | |
|---|---|---|
| EP | 0174068 A1 | 3/1986 |
| EP | 0598656 A1 | 11/1993 |
| GB | 1 574 196 | of 1890 |
| GB | 2 147 744 A | 5/1985 |
| GB | 2 268 626 A | 1/1994 |
| JP | 01-189208 | 7/1989 |
| JP | 2833802 | 7/1991 |
| JP | 10-098322 | 4/1998 |
| JP | 2000-261235 | 9/2000 |
| WO | WO 96/39728 | 12/1996 |
| WO | WO 99/59221 | 11/1999 |

OTHER PUBLICATIONS

Noghanian et al.; "Control of microstrip antenna radiation characteristics by ground plane size and shape"; IEEE Proceedings: Microwaves, Antennas and Propagation; vol. 145; No. 3; Jun. 1998; Abstract, Fig. 1.

Karmakar et al/; "Investigations into a circular patch antenna in a cylindrical cavity enclosure"; Singapore ICCS '94. Conference Proceedings. Singapore 14–18 Nov. 1994; Abstract, Fig. 1.

* cited by examiner

*Primary Examiner*—Tho Phan
(74) *Attorney, Agent, or Firm*—Stites & Harbison PLLC; Ross F. Hunt, Jr.

(57) ABSTRACT

A dielectric antenna includes a plate-shaped dielectric substrate, a radiation electrode provided on a first main surface of the dielectric substrate so as to cover the first main surface except for a peripheral portion thereof, and a ground electrode formed on the entirety of a second main surface of the dielectric substrate. A feed electrode extends through the dielectric substrate from the first main surface to the second main surface. A feed point of the feed electrode is electrically connected to the radiation electrode. A plurality of through-hole electrodes providing an electrical shield are formed in a peripheral portion of the dielectric substrate so as to surround the radiation electrode, the through-hole electrodes being connected to the ground electrode. Alternatively, instead of the through-hole electrodes, the dielectric antenna may include a shield electrode formed on a side surface of the dielectric substrate and connected to the ground electrode.

6 Claims, 3 Drawing Sheets

DIELECTRIC ANTENNA

BACKGROUND OF THE INVENTION

1. Field of the Invention

The present invention relates to a dielectric antenna for use in portable terminals and in radio communication devices.

2. Description of Related Art

Japanese Patent Application Laid-Open (kokai) No. H10-98322 discloses a dielectric antenna of the above-mentioned type. In that dielectric antenna, a radiation electrode serving as an antenna element is provided on a first main surface of a plate-shape dielectric substrate, whereas a ground electrode is provided over the entirety of a second main surface of the dielectric substrate. The radiation electrode is formed so as to be smaller than the ground electrode. A coaxial feeder is disposed in such a manner that the center conductor of the coaxial feeder passes through the dielectric substrate from the second main surface to the first main surface, and the outer conductor of the coaxial feeder is connected to the ground electrode.

Japanese Patent Application Laid-Open (kokai) No. 2000-261235 discloses a microstrip antenna configured so as to use a tri-plate line as a feed line. In that microstrip antenna, a pair of ground conductors, are formed on outer surfaces of two feed dielectric layers stacked one on the other, and a center conductor is formed between the pair of ground conductors. Further, a third dielectric layer is stacked on one of the pair of ground conductors, and a radiation electrode is formed on an outer surface of the third dielectric layer. A shield member connects the pair of ground conductors together to thereby provide electrical shielding between the space inside the shield member and the space outside the shield member.

Japanese Patent No. 2833802 discloses a microstrip antenna configured in such a manner that a radiation conductor is provided on a first main surface of a plate-shape dielectric substrate so as to be located at a substantially central portion of the first main surface, and a first ground conductor is provided over the entirety of a second main surface of the dielectric substrate. In that microstrip antenna, a second ground conductor for reducing electric fields between the radiation conductor and the first ground conductor is provided on a peripheral portion of the plate-shape dielectric substrate, and the distance between the radiation conductor and the first ground conductor is shortened, whereby electric fields formed in the air between a peripheral edge portion of the radiation conductor and the ground conductor are reduced.

Dielectric antennas of the above-described types are conventionally incorporated into portable terminals and radio communication devices. However, portable terminals and radio-communication devices have increasingly been made smaller in size, i.e., miniaturized, and reduced in weight, in order to make the use thereof more convenient. With the miniaturization of the overall devices associated therewith, there has been an increasing demand for miniaturization of dielectric antennas in order to enable installation of a dielectric antenna within a limited space. However, even when a miniaturized dielectric antenna is employed, the dielectric antenna is, in practice, mounted on a printed circuit board so as to be located adjacent to other electronic circuit elements and metallic parts. As a consequence, the mounted dielectric antenna is influenced by electronic circuit elements and metallic parts surrounding the antenna, with the result that the electrical characteristics of the antenna are unstable. One conceivable technique for solving this problem is to provide a shield member around the dielectric antenna so as to reduce the destabilizing influences. However, the provision of such a shield member is undesirable because of the limited installation space available and the resultant increase in the number of parts required, thus adding to the overall cost and making miniaturization of the overall device more difficult.

SUMMARY OF THE INVENTION

In view of the foregoing, an object of the present invention is to provide a dielectric antenna which is not influenced by surrounding metallic parts and electronic parts and, therefore, has stable electric characteristics.

To achieve the foregoing and other objects, there is provided, in accordance with one aspect of the present invention, a dielectric antenna comprising: a plate-shaped dielectric substrate having first and second main surfaces; a radiation electrode provided on the first main surface of the dielectric substrate so as to cover the first main face except for, i.e., apart from, a peripheral portion thereof; a ground electrode formed on the entirety of the second main surface of the dielectric substrate; a feed electrode extending through the dielectric substrate from the first main surface to the second main surface, a feed point of the feed electrode being electrically connected to the radiation electrode; and a plurality of through-hole electrodes formed in a peripheral portion of the dielectric substrate so as to surround the radiation electrode, the through-hole electrodes being connected to the ground electrode.

The above-described configuration enables the antenna itself to perform a shielding function, and thereby eliminates the necessity of incorporating a separate shield member into the device or equipment into which the antenna is mounted or incorporated. Therefore, the configuration of the present invention is advantageous from the viewpoints of both cost and space savings. Further, the antenna is unlikely to be influenced by electronic parts and metallic parts disposed around the antenna, so that adverse influences on the electrical characteristics of the antenna are mitigated so as to thereby stabilize the electrical characteristics of the antenna.

Preferably, the dielectric substrate is of a substantially rectangular shape as viewed from the first main surface, and the plurality of through-hole electrodes include through-hole electrodes formed along each side of the rectangular shaped substrate at substantially constant intervals, i.e., with substantially constant spacing between the through-hole electrodes.

Preferably, one corner portion of the dielectric substrate is chamfered, the radiation electrode is of a substantially rectangular shape corresponding to the rectangular shape of the dielectric substrate, and a first corner portion of the radiation electrode corresponding to the chamfered corner portion of the dielectric substrate, and a second corner portion of the radiation electrode diagonally opposite the first corner portion, are each cut at an angle equal to the chamfer angle of the chamfered corner portion of the dielectric substrate.

Preferably, the feed electrode is provided at a position offset from a center of the dielectric substrate as viewed from the first main surface.

In accordance with a further aspect of the present invention, there is provided a dielectric antenna comprising: a plate-shaped dielectric substrate having first and second main surfaces; a radiation electrode provided on the first main surface of the dielectric substrate so as to cover the first main face except for a peripheral portion thereof; a ground electrode formed on the entirety of the second main surface of the dielectric substrate; a feed electrode extending through the dielectric substrate from the first main surface to the second main surface, a feed point of the feed electrode being electrically connected to the radiation electrode; and a shield electrode formed on a side surface of the dielectric substrate and connected to the ground electrode.

The above-described configuration also enables the antenna itself to perform a shielding function, and to thereby eliminate the necessity of incorporating a separate shield member into the device or equipment in which the antenna is mounted. Therefore, this configuration of the present invention is also advantageous from the viewpoints of both cost and space savings. Further, as with the first embodiment, the antenna is unlikely to be influenced by electronic parts and metallic parts disposed near or around the antenna, so that any adverse effects on the electrical characteristics of the antenna can be mitigated so as to stabilize the electrical characteristics of the antenna.

Preferably, the dielectric substrate is of a substantially rectangular shape as viewed from the first main surface, and a substantially rectangular shield electrode is formed on each of four side surfaces of the dielectric substrate. In this implementation, the shield electrode may be connected to the ground electrode through one side of the shield electrode, and the remaining sides of the shield electrode may be spaced or separated from corresponding sides of the corresponding side surface. Alternatively, the shield electrode may be connected to the ground electrode through one side of the shield electrode, and the remaining sides of the shield electrode extend to corresponding sides of the corresponding side surface of the dielectric substrate, so that the shield electrodes on the four side surfaces are connected with one another in the circumferential direction, i.e., are laterally connected together.

Preferably, in this embodiment as well, one corner portion of the dielectric substrate is chamfered, the radiation electrode is of a substantially rectangular shape corresponding to the rectangular shape of the dielectric substrate, and a first corner portion of the radiation electrode corresponding to the chamfered corner portion of the dielectric substrate, and a second corner portion of the radiation electrode diagonally opposite the first corner portion, are each cut at an angle equal to the chamfer angle of the chamfered corner portion of the dielectric substrate.

Preferably, in this embodiment as well, the feed electrode is provided at a position offset from a center of the dielectric substrate as viewed from the first main surface.

Further features and advantages of the present invention will be set forth in, or apparent from, the detailed description of preferred embodiments thereof which follows.

DESCRIPTION OF THE PREFERRED EMBODIMENTS

Several preferred embodiments of the present invention will be described with reference to the accompanying drawings.

Figure 1:
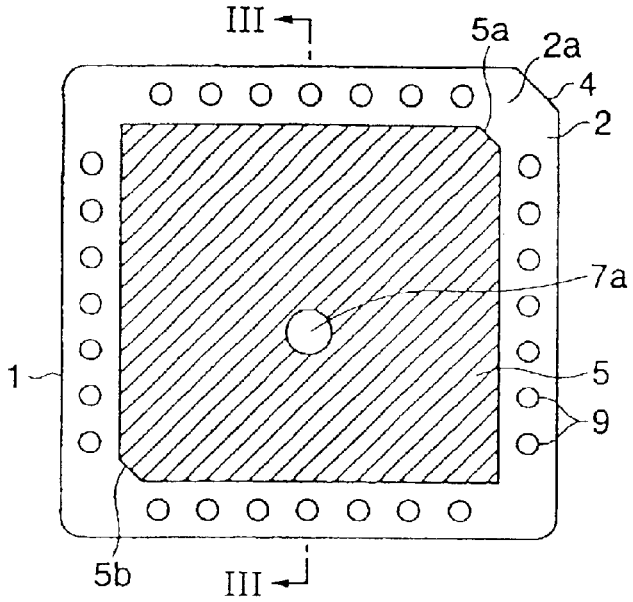
FIG. 1 is a schematic plan view of a dielectric antenna according to a first embodiment of the present invention.
Figure 2:
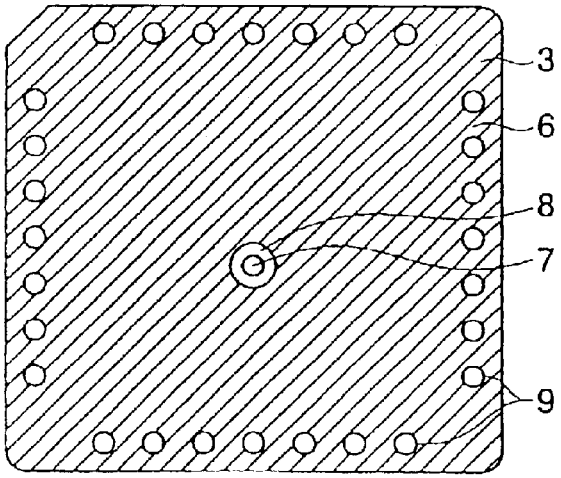
FIG. 2 is a schematic bottom view of the dielectric antenna of FIG. 1.
Figure 3:
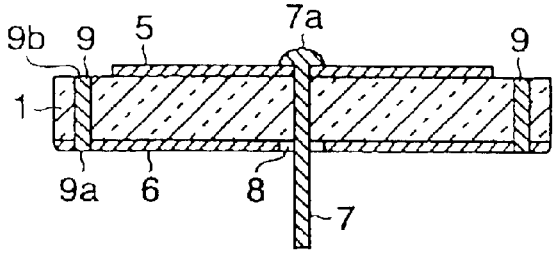
FIG. 3 is a schematic cross-sectional view taken along line III—III of FIG. 1.
Figure 4:
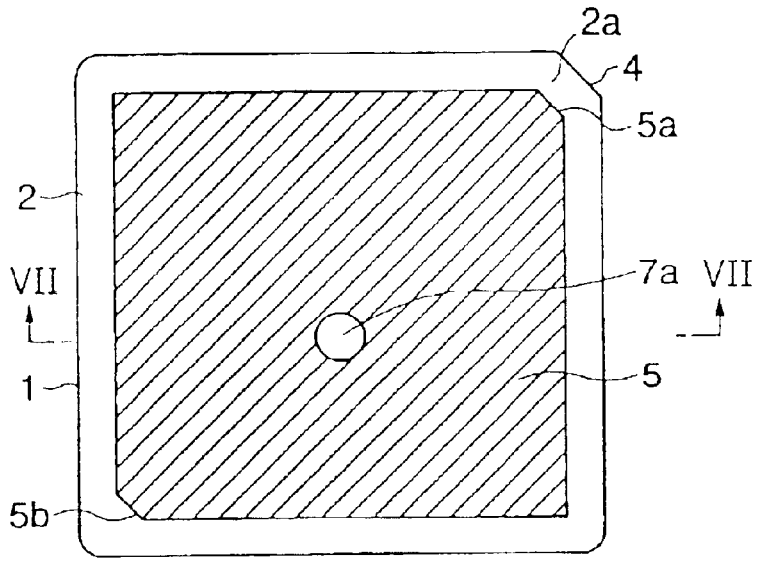
FIG. 4 is a schematic plan view of a dielectric antenna according to a second embodiment of the present invention.

First Embodiment:

FIGS. 1 to 3 show a dielectric antenna according to a first embodiment of the present invention. The illustrated dielectric antenna includes a plate-shaped dielectric substrate 1, which is formed of a dielectric ceramic material. In the illustrated embodiment, the dielectric substrate 1 has a square shape, and has a first main surface 2 and a second main surface 3. As illustrated, one corner portion 4 of the dielectric substrate 1 is chamfered. The chamfered corner portion 4 serves the function of indicating the directivity of the antenna.

A radiation electrode 5 is provided on the first main surface 2 of the dielectric substrate 1 in such a manner that the radiation electrode 5 does not cover a peripheral portion 2*a* of the first main face 2. The radiation electrode 5 is preferably formed by use of a suitable film forming technique. A corner portion 5*a* of the radiation electrode 5 corresponding to the chamfered corner portion 4 of the dielectric substrate 1, and a corner portion 5*b* of the radiation electrode 5 diagonally opposite the corner portion 5*a*, are each cut at an angle equal to the chamfer angle of the corner portion 4.

Further, as shown in FIG. 2, a ground electrode 6 is formed on the entirety of the second main surface 3 of the dielectric substrate 1.

At a position shifted or offset from the center of the plate-shaped dielectric substrate 1, a feed electrode 7 is provided so as to extend through the dielectric substrate 1 from the first main surface 2 to the second main surface 3. A feed point 7*a* of the feed electrode 7 is electrically connected to the radiation electrode 5. As indicated by the area referenced by reference numeral 8 in FIGS. 2 and 3, the feed electrode 7 is electrically insulated from the ground electrode 6 on the second main surface 3.

A plurality of through-hole electrodes 9 are formed in a peripheral portion of the dielectric substrate 1 so as to surround the radiation electrode 5. These through-hole electrodes 9 are formed by using silver paste to fill or coat through-holes formed in substrate 1 by press-molding. As shown in FIG. 3, first ends 9*a* of the through-hole electrodes 9 are connected to the ground electrode 6, whereas second ends 9*b* of the through-hole electrodes 9 are opened to, i.e., terminate at, the peripheral portion 2*a* of the first main surface 2 of the dielectric substrate 1.

Exemplary dimensions of the illustrated dielectric antenna having the above-described configuration are as follows.

Size of the dielectric substrate 1: 23.6 mm (length)×23.6 mm (width)×4.0 mm (height)

Size of the radiation electrode 5: 19.4 mm (length)×19.8 mm (width)

Size of the ground electrode 6: 23.6 mm (length)×23.6 mm (width)

Size of the feed electrode 7: 7.8 mm (length)×0.8 mm (diameter)

Number of the through-hole electrodes 9: 28

Diameter of each through-hole electrode 9: 0.5 mm

In the first embodiment illustrated in FIGS. 1 to 3, the antenna is of a rectangular shape. However, the antenna may assume a polygonal or circular shape.

In the illustrated embodiment, the through-hole electrodes 9 each have a circular cross section. However, the through-hole electrodes 9 may have a cross section of an arbitrary shape, such as a rectangular shape. Further, instead of the through-hole electrodes 9, there may be employed slot or slit-shaped groove electrodes (not shown), serving as through-hole electrodes. These groove electrodes would extend inwardly from the circumferential surface of the dielectric substrate 1 and, preferably, would also be coated with silver paste.

Second Embodiment:

FIGS. 4 to 7 show a dielectric antenna according to a second embodiment of the present invention. The illustrated dielectric antenna includes a plate-shaped dielectric substrate 1, which is formed of a dielectric ceramic material. In the illustrated embodiment, the dielectric substrate 1 has a square shape, and has a first main surface 2 and a second main surface 3. As shown, one corner portion 4 of the dielectric substrate 1 is chamfered. The chamfered corner portion 4 serves the function of indicating the directivity of the antenna.

A radiation electrode 5 is provided on the first main surface 2 of the dielectric substrate 1 in such a manner that the radiation electrode 5 does not cover a peripheral portion 2*a* of the first main face 2. The radiation electrode 5 is preferably formed by use of a suitable film forming technique. A corner portion 5*a* of the radiation electrode 5 corresponding to the chamfered corner portion 4 of the dielectric substrate 1 and a corner portion 5*b* of the radiation electrode 5 diagonally opposite the corner portion 5*a* are each cut at an angle equal to the chamfer angle of the corner portion 4.

Figure 5:
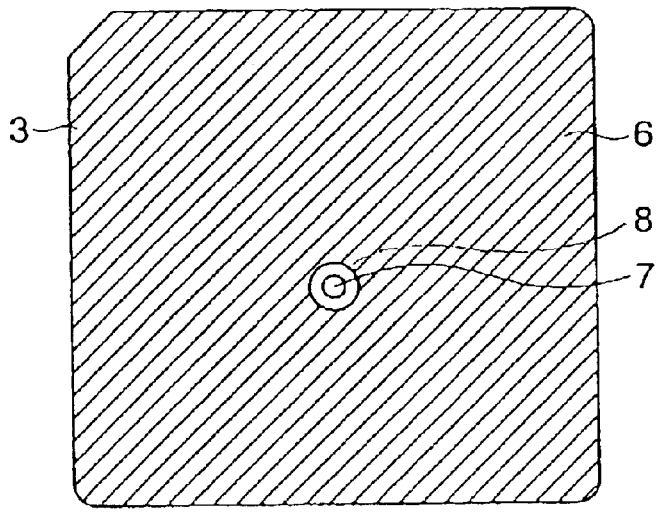
FIG. 5 is a schematic bottom view of the dielectric antenna of FIG. 4.

Further, as shown in FIG. 5, a ground electrode 6 is formed on the entirety of the second main surface 3 of the dielectric substrate 1.

At a position shifted or offset from the center of the plate-shaped dielectric substrate 1, a feed electrode 7 is provided so as to extend through the dielectric substrate 1 from the first main surface 2 to the second main surface 3. A feed point 7*a* of the feed electrode 7 is electrically connected to the radiation electrode 5. As indicated by the area referenced by reference numeral 8 in FIGS. 5 and 7, the feed electrode 7 is electrically insulated from the ground electrode 6 on the second main surface 3.

Figure 6:
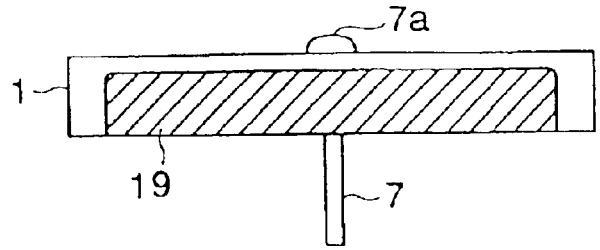
FIG. 6 is a schematic side view of the dielectric antenna of FIG. 4.
Figure 7:
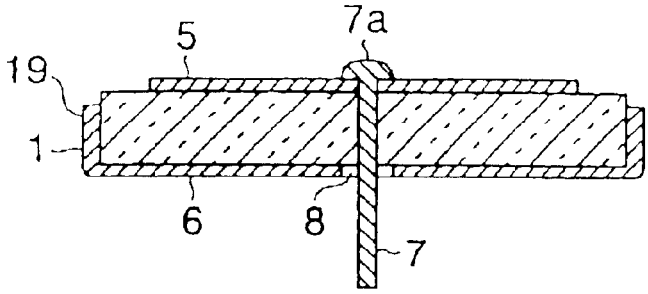
FIG. 7 is a schematic cross-sectional view taken along line VII—VII of FIG. 4.

As best seen in FIGS. 6 and 7, a shield electrode 19 is independently provided on each of four side surfaces of the dielectric substrate 1. Each shield electrode 19 is connected to the ground electrode 6, and, as shown in FIG. 6, three sides of each shield electrode 19 which are not connected to the ground electrode 6 are spaced or separated from corresponding edges of the dielectric substrate 1.

Exemplary dimensions and material of the dielectric antenna illustrated in FIGS. 4 to 7 having the above-described configuration are as follows.

Material of the dielectric substrate 1: dielectric ceramic having a dielectric constant of 21

Size of the dielectric substrate 1: 23.6 mm (length)×23.6 mm (width)×4.0 mm (height)

Size of the radiation electrode 5: 19.4 mm (length)×19.8 mm (width)

Size of the ground electrode 6: 23.6 mm (length)×23.6 mm (width)

Size of the feed electrode 7: 7.8 mm (length)×0.8 mm (diameter)

Size of the shield electrodes 19: 3.0 mm (length)×2.0 mm (width)

It is noted that in the second embodiment illustrated in FIGS. 4 to 7, the antenna is of a rectangular shape. However, the antenna may also be of another shape such as a polygonal or circular shape.

Figure 8:
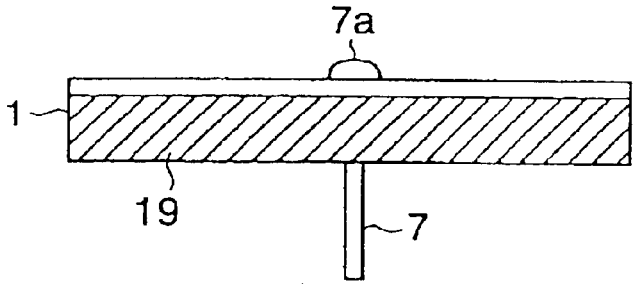
FIG. 8 is a schematic side view of a dielectric antenna according to a modification of the second embodiment.

In the second embodiment described above, parts of the shield electrode 19 are individually formed on each of the four sides of the dielectric substrate 1. However, as shown in FIG. 8, the shield electrode 19 may be formed continuously on the four sides of the dielectric substrate 1. Specifically, in FIG. 8, the shield electrode 19 is connected to the ground electrode 6 through one side of the shield electrode 19, and the remaining sides of the shield electrode 19 extend to corresponding sides of the corresponding side surface of the dielectric substrate 1, so that the shield electrodes 19 on all four side surfaces are connected with one another in the circumferential direction, i.e., are laterally connected together.

Although the invention has been described above in relation to preferred embodiments thereof, it will be understood by those skilled in the art that variations and modifications can be effected in these preferred embodiments without departing from the scope and spirit of the invention.

What is claimed is:

1. A dielectric antenna comprising:

a plate-shaped dielectric substrate having first and second main surfaces;

a radiation electrode provided on the first main surface of the dielectric substrate so as to cover the first main surface apart from a peripheral portion thereof;

a ground electrode formed on the entirety of the second main surface of the dielectric substrate;

a feed electrode extending through the dielectric substrate from the first main surface to the second main surface, a feed point of the feed electrode being electrically connected to the radiation electrode; and a plurality of through-hole electrodes formed in a peripheral portion of the dielectric substrate so as to surround the radiation electrode, the through-hole electrodes being connected to the ground electrode, the dielectric substrate being of a substantially rectangular shape as viewed from the first main surface, and the plurality of through-hole electrodes including through-hole electrodes formed along each side of the dielectric substrate with substantially constant spacing therebetween, one corner portion of the dielectric substrate being chamfered at a chamfer angle; the radiation electrode being of a substantially rectangular shape corresponding to the rectangular shape of the dielectric substrate; and a first corner portion of the radiation electrode corresponding to the chamfered corner portion of the dielectric substrate and a second corner portion of the radiation electrode diagonally opposite the first corner portion each being cut at an angle equal to the chamfer angle of the chamfered corner portion of the dielectric substrate.

2. A dielectric antenna according to claim 1, wherein the feed electrode is disposed at a position offset from a center of the dielectric substrate as viewed from the first main surface.

3. A dielectric antenna comprising:

a plate-shaped dielectric substrate having first and second main surfaces;

a radiation electrode provided on the first main surface of the dielectric substrate so as to cover the first main face apart from a peripheral portion thereof;

a ground electrode formed on the entirety of the second main surface of the dielectric substrate;

a feed electrode extending through the dielectric substrate from the first main surface to the second main surface, a feed point of the feed electrode being electrically connected to the radiation electrode; and a shield electrode formed on a side surface of the dielectric substrate and connected to the ground electrode, the dielectric substrate being of a substantially rectangular shape as viewed from the first main surface; and a substantially rectangular shield electrode being formed on each of four side surfaces of the dielectric substrate, the shield electrode being connected to the around electrode through one side of the shield electrode, and the remaining sides of the shield electrode being separated from corresponding sides of the corresponding side surface.

4. A dielectric antenna according to claim 3, wherein the shield electrode is connected to the ground electrode through one side of the shield electrode, and the remaining sides of the shield electrode extend to corresponding sides of the corresponding side surface of the dielectric substrate, so that the shield electrodes on the four side surfaces are laterally connected to one another.

5. A dielectric antenna comprising:

a plate-shaped dielectric substrate having first and second main surfaces;

a radiation electrode provided on the first main surface of the dielectric substrate so as to cover the first main face apart from a peripheral portion thereof;

a ground electrode formed on the entirety of the second main surface of the dielectric substrate;

a feed electrode extending through the dielectric substrate from the first main surface to the second main surface, a feed point of the feed electrode being electrically connected to the radiation electrode; and a shield electrode formed on a side surface of the dielectric substrate and connected to the ground electrode, the dielectric substrate being of a substantially rectangular shape as viewed from the first main surface; and a substantially rectangular shield electrode being formed on each of four side surfaces of the dielectric substrate, one corner portion of the dielectric substrate being chamfered at a chamfer angle;

the radiation electrode being of a substantially rectangular shape corresponding to the rectangular shape of the dielectric substrate; and a first corner portion of the radiation electrode corresponding to the chamfered corner portion of the dielectric substrate and a second corner portion of the radiation electrode diagonally opposite the first corner portion each being cut at an angle equal to the chamfer angle of the chamfered corner portion of the dielectric substrate.

6. A dielectric antenna according claim 5, wherein the feed electrode is provided at a position offset from a center of the dielectric substrate as viewed from the first main surface.

* * * * *